United States Patent [19]

Scheffel

[11] 4,067,261

[45] Jan. 10, 1978

[54] DAMPING RAILWAY VEHICLE SUSPENSION

[75] Inventor: Herbert Scheffel, Pretoria South Africa

[73] Assignee: South African Inventions Development Corporation, Pretoria, Transvaal, South Africa

[21] Appl. No.: 702,304

[22] Filed: July 2, 1976

Related U.S. Application Data

[63] Continuation-in-part of Ser. No. 415,232, Nov. 12, 1973, abandoned, and a continuation-in-part of Ser. No. 565,888, April 7, 1975.

[30] Foreign Application Priority Data

| | | |
|---|---|---|
| Nov. 10, 1972 | South Africa | 72/7978 |
| Nov. 10, 1972 | South Africa | 72/7979 |
| Oct. 9, 1973 | South Africa | 73/7884 |
| Oct. 9, 1973 | South Africa | 73/7885 |
| Apr. 5, 1974 | South Africa | 74/2192 |
| Apr. 22, 1974 | South Africa | 74/2546 |
| Nov. 11, 1974 | South Africa | 74/5770 |

[51] Int. Cl.[2] ..... B61F 3/10; B61F 5/14; B61F 5/24; B61F 5/30

[52] U.S. Cl. ..... 105/157 R; 105/164; 105/175 R; 105/176; 105/182 R; 105/197 D; 105/199 R; 105/210; 105/218 R; 105/224.1; 295/34

[58] Field of Search ..... 105/157 R, 164, 165, 105/175 A, 175 R, 176, 182 R, 197 D, 199 R, 208.1, 210, 218 R, 224.1; 295/34

[56] References Cited

U.S. PATENT DOCUMENTS

| | | | |
|---|---|---|---|
| 70,492 | 11/1867 | Youmans | 105/182 R |
| 688,485 | 12/1901 | Robbins | 105/182 R |
| 1,138,357 | 5/1915 | Curwen | 105/165 X |
| 1,293,628 | 2/1919 | Coda | 295/34 |
| 1,640,179 | 8/1927 | Buckwalter | 105/182 R |
| 1,772,928 | 8/1930 | Kijlstra | 105/182 R |
| 2,052,660 | 9/1936 | Rocard | 295/34 X |
| 2,168,293 | 8/1939 | Kiesel, Jr. | 105/182 R |
| 2,352,039 | 6/1944 | Travilla, Jr. | 105/199 R |
| 2,394,548 | 2/1946 | Hickman | 105/182 R |
| 3,528,374 | 9/1970 | Wickens | 105/182 R |
| 3,638,582 | 2/1972 | Beebe | 105/218 R |
| 3,690,271 | 9/1972 | Hobbs | 105/175 A X |
| 3,696,757 | 10/1972 | Newman et al. | 105/175 A X |

FOREIGN PATENT DOCUMENTS

| | | | |
|---|---|---|---|
| 1,006,038 | 1/1952 | France | 105/175 A |
| 722,414 | 7/1942 | Germany | 105/182 R |
| 865,148 | 1/1953 | Germany | 105/175 A |
| 876,249 | 5/1953 | Germany | 105/175 A |
| 2,144,157 | 3/1973 | Germany | 105/182 R |
| 354,147 | 8/1931 | United Kingdom | 105/175 A |
| 611,237 | 10/1948 | United Kingdom | 105/175 A |

*Primary Examiner*—Robert J. Spar
*Assistant Examiner*—Howard Beltran
*Attorney, Agent, or Firm*—Ladas, Parry, Von Gehr, Goldsmith & Deschamps

[57] ABSTRACT

A damping suspension for a railway truck having load-bearing members supported on at least two live wheelsets which are self-steering and which are directly interconnected to couple their yawing movements in opposite senses. The wheelsets are self-steering in that they each have profiled treads of high effective conicity and each is suspended by resilient elements having a low elastic yaw constraint to the load-bearing members. The yaw constraints imposed by the resilient elements are lower than the steering forces generated on the wheelsets on curved track as a result of the tread profile. The coupling between the wheelsets takes the form of diagonally connected resilient members for ensuring that the wheelsets do not oscillate in phase with the load-bearing members to thereby damp any hunting oscillations that may tend to occur.

14 Claims, 32 Drawing Figures

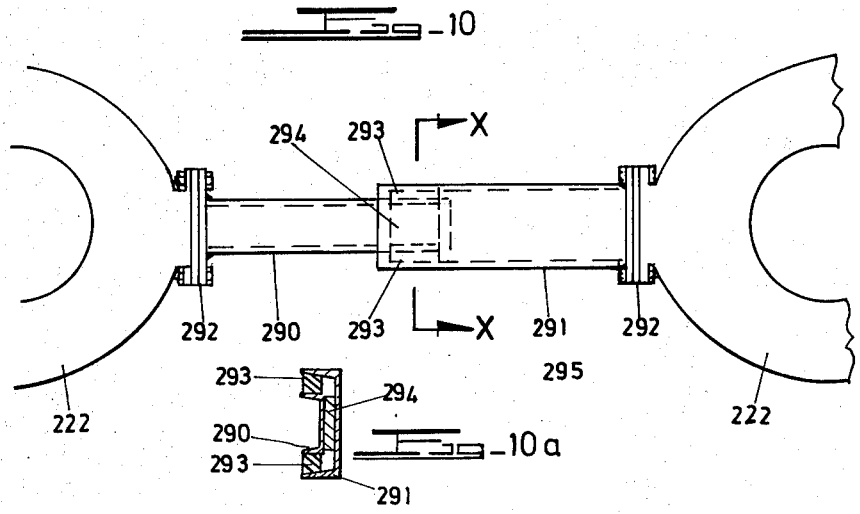
Fig. 10
Fig. 10a
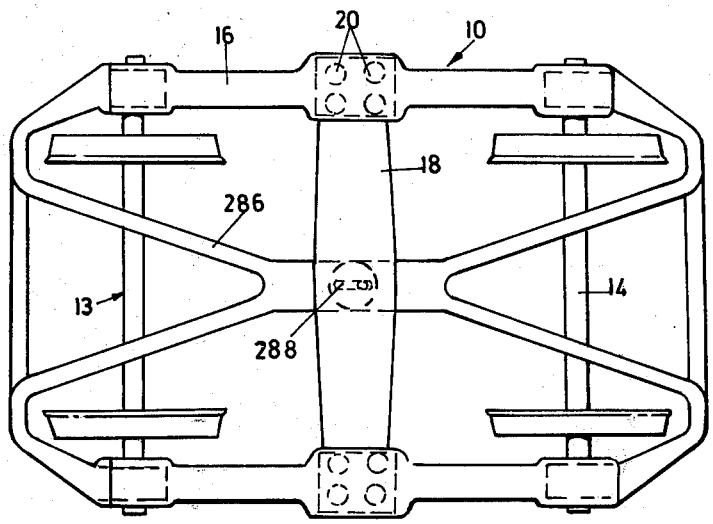
Fig. 15
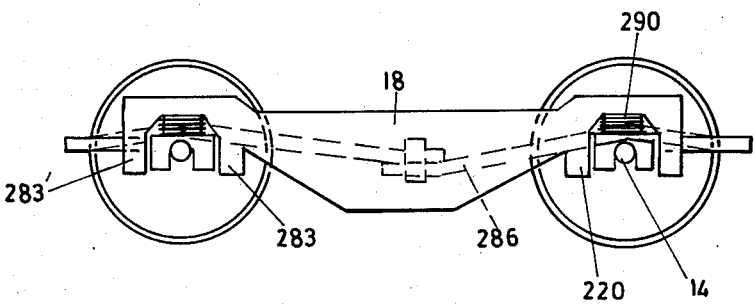
Fig. 16

DAMPING RAILWAY VEHICLE SUSPENSION

RELATED APPLICATIONS

This application is a continuation-in-part of my copending application Ser. No. 415,232 filed Nov. 12, 1973, now abandoned and a continuation-in-part of my copending application Ser. No. 565,888 filed Apr. 7, 1975.

This invention relates to railway vehicle suspensions. In particular, it is concerned with a suspension for a railway truck which simultaneously provides for good curving ability and hunting stability of the truck.

Railway vehicles are dynamically unstable and the various parts of a vehicle tend to oscillate laterally when it is moving. The effect of these oscillations is commonly referred to as hunting and distinction is made in the art among body, bogie frame, and wheelset hunting.

For guiding the vehicle, such as in cornering and for correcting deviations from the centre of the track it has been found to be desirable to use a wheel set arrangement in which the wheels, with conical or profiled wheel treads, are rigidly mounted on common axles. This arrangement is dynamically unstable because of the conicity of the wheels and the creep or slip forces acting between the wheels and the rails. This instability is evidence by sinusoidal oscillations of the wheelsets, the frequency of which is dependent primarily on the speed of the vehicle. Further, the wheelsets have a natural oscillation because they are connected to the vehicle body by elastic suspension elements. At certain speeds the natural and speed-dependent oscillations combine and the amplitude of the resulting oscillation is the factor which limits the maximum practical speed of the vehicle.

It has been found that increased wheel tread conicity lowers, and increased longitudinal or yaw constraint of the wheelsets raises, the critical speed for wheelset hunting. For these reasons, known suspensions employ relatively stiff longitudinal elements such as axle guards, radius arms, anchors and the like, and relatively small wheel tread conicities ranging from 1/20 to 1/40 the latter being used with very high-speed passenger vehicles.

However, since stiff longitudinal elements resist yawing of the wheelsets, curving is attained by the wheels slipping on the rails and even in moderate curves by the flange of the outside wheel of the leading wheelset contacting the inside of the rail. Further, low tread conicities do not allow for the correct or optimum difference as differential effect to be attained in the rolling diameters of the inner and outer wheels. Therefore with conventional suspensions, there is a conflict between wheelset hunting stability and steering ability.

Another problem encountered with conventional designs is that is has been difficult, because of their high effective conicity, to use "standard wear" profiles for the wheel treads, i.e. a profile where the conicity does not change appreciably with wheel tread wear. Conventional wheel treads show very high wear tendencies because of the hunting of the wheelsets and also because of the inability of the wheels to follow the curvature of the track during cornering, i.e. they have to rely on wheel flange/rail contact. Such wear of conventional treads changes the parameters which determine the hunting stability of the vehicle which, therefore, varies over the service life of the vehicle.

For the above reasons as well as other considerations such as riding quality, initial cost, etc., suspension design has generally concentrated on finding a compromise between the various parameters in order to obtain an optimum solution. Such compromises minimise the problems, but by no means eliminate them.

Since the above outlined problems are of great commercial and practical importance considerable effort has been expended in analysing suspension systems which might resolve the abovementioned conflict. For example, inter alia, A. H. Wickens (Int. J. Solids Structures, 1965, Vol. 1 pp 319 to 341 and an article entitled "The Dynamics of Railway Vehicles on Straight Track", 1965) and D. E. Newland (Transactions of the ASME, August 1969, pp 908 to 918) have investigated so-called "flexible suspensions". Wickens, who was primarily concerned with hunting never used or considered using yaw constraints sufficiently low for flange free curving, because he considered the consequent hunting problems would be insurmountable. He felt damping would be essential for minimising feedback of the natural oscillations of the various masses. Newland, who was solely concerned with the curving ability of a vehicle, estimated that even with his suggested low stiffnesses flange free curving could not be attainted with curve radii less than 0.47 miles on 4 feet 8½ inches track. These analyses were purely theatrical and practical designs were not put forward. Wickens has had some practical success with Four-Wheelers using flexible suspensions, but has said that such suspensions cannot be used for bogie vehicles because of the complex hunting stability situation; there are, in fact, thirteen hunting instability resonance peaks associated with bogie vehicles.

It is an object of this invention to provide a suspension for a railway vehicle which resolves the conflict between hunting stability and curving ability in a satisfactory manner.

For the purposes of this specification the term "railway truck" is defined to mean a basic railway unit comprising at least one load-bearing member supported on at least two wheelsets. A railway truck may, therefore, be a Four-Wheeler or else it may be a bogie, on two of which a superstructure can be pivotally mounted to form a vehicle. The term "superstructure" refers specifically to a bogie vehicle situation.

The invention provides a railway truck including at least one load-bearing member supported on at least two live wheelsets with the improvement that each wheelset is substantially self-steering in that the wheels each have profiled treads whereby steering forces are generated on the wheelsets on curved track and any constraints on the wheelsets are lower than the steering forces generated on curved track; and that means is provided to couple the wheelsets to transmit yawing and lateral movements of either wheelset in opposite sense to the other wheelset whereby any tendency to increased hunting and lowering of the critical hunting speed of the truck caused by the self-steering characteristic of each wheelset is counteracted without interfering with the self-steering characteristic of either wheelset.

The self-steering characteristic of each wheelset provides the truck with a good curving ability. Hunting stability for the truck is provided by the coupling means which makes the wheelsets, when they tend to do so, to hunt 180° out of phase with each other. The wheelsets, therefore, also hunt out of phase with the load-bearing member(s). This ensures that hunting stabilizing creep forces are generated in the contact areas between the wheel-treads and the rails.

In its preferred form the wheelsets are suspended to the load-bearing member(s) through elastic constraint means which provide elastic yaw constraints on the wheelsets relatively to the load-bearing members which are sufficiently low to permit self-steering. By ensuring that the wheelsets oscillate out of phase with each other and the load-bearing member(s) these elastic constraint means can absorb energy from a wheelset during one part of its hunting cycle and then release the energy back to the wheelset during another part of its hunting cycle when stabilizing creep forces can be generated. Thus, each elastic constraint means is made to be effective for stabilizing hunting even though it is sufficiently low to permit the wheelsets to be self-steering.

A particularly important feature of the truck of the invention is that, since the wheelsets are self-steering and since hunting is minimised, there is minimal tread wear. Futhermore the wheel tread profile can approximate to that of the so called "standard wear profile" or Heumann profile so that any tread wear does not change the profile significantly. Thus, because the tread profile remains constant in service, the hunting stability of the truck will also be substantially constant during the service life of the vehicle.

Railway vehicles wheels wear mainly as a result of rail/wheel-flange contact and slip between the wheels and the rails. Theory by the inventor shows that such contact and such slip can be avoided so that the wheels will perform a rolling motion, i.e. the wheelsets will be self-steering, and so that the means interconnecting the wheelsets to couple their yawing movements in opposite senses if, for normal curve radii encountered on railway track, "C" the yaw constraint or constraint against yawing of the wheelsets relatively to the load-bearing members of the truck is equal to or less than:

$$2\,G_r l^2 \qquad (1)$$

where $G_r$ is known in the art as the "gravitational suspension stiffness" and is approximately equal to $$\tfrac{1}{2}\,W\gamma/R\delta_o$$

and where,

W = maximum axle load for each wheelset,

R = the radius of curvature of the profile of the profiled wheel treads, $\gamma$ = the effective conicity of the profiled wheel-treads, $\delta$ = the angle between the wheel/rail contact plane and the horizontal with the wheelset in its central position (also known as "rail cant"), and l = half the distance between the wheel/rail contact points on the same axle.

The yaw constraint C is expressed in terms of a moment or couple per radian (i.e. Nm/rad or lb.ft/rad).

If the wheelsets are suspended to the load-bearing members by elastic elements then the yaw constraint imposed by these elements is dependent on their stiffness "K" (force per unit displacement) in the longitudinal direction of the truck and their spacing along the length of the axle of the wheelset. A simple analysis will show that for small yaw angles, as is the situation in practice, the yaw constraint "C" is related to the longitudinal stiffness "K" of each of the elastic elements by the following equation:

$$C = 2.K.b^2$$

where $b$ = half the distance between resilient elements suspending the wheelsets to the load-bearing members.

From relationship (1) and the equation above, the longitudinal stiffness "K" of each resilient element suspending a wheelset to a load-bearing member can be obtained from:

$$K \leqq G_r l^2/b^2 \qquad (2)$$

The longitudinal stiffness "K" is dependent on the spacing "b" between the resilient elements; the longitudinal stiffness of each element can be increased as they are moved closer to each other along the length of the axle.

If the yaw constraint C or longitudinal stiffness K is made according to the above relationships (1) or (2), respectively, then this will ensure that the coupling means will be unstressed during curving and not subject to wear in any of its joints. Thus the coupling means can be of a light and compact construction which assists in fitting it into a bogie where space is limited and also ensures that it will not add significantly to the unsprung mass.

As a practical matter the yaw constraint C can be increased up to about four times the value given by relationship (1) and reasonable rolling motion and substantial self-steering of the wheelsets still be maintained. For outboard bearings on a truck to run on 3 feet 6 inches, e.g. as in South Africa, the longitudinal stiffness K of the elastic elements can be made to be about $W\gamma/R\delta_o$ or, in other words about 2 $G_r$.

FIGS. 10 and 10*a* show a coupling member for a means for interconnecting yawing movements of a pair of wheelsets in opposite sense, 10*a* being a section along X — X of FIG. 10.

Figure 12:
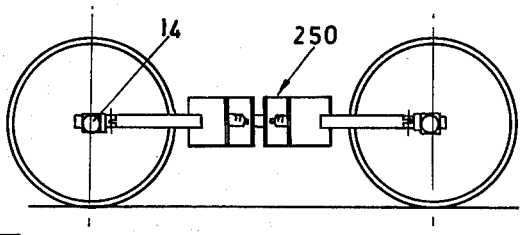
Figure 11:
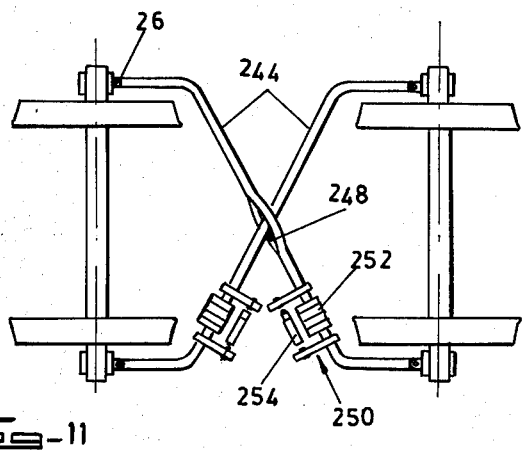
Figure 14:
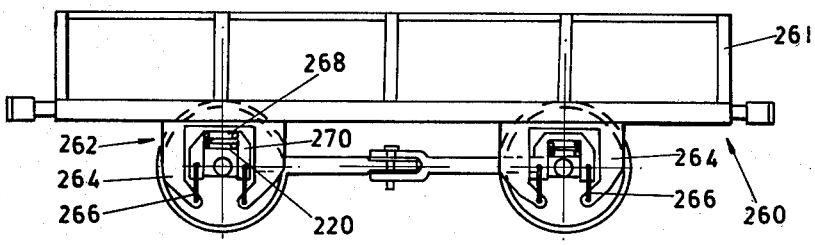
Figure 13:
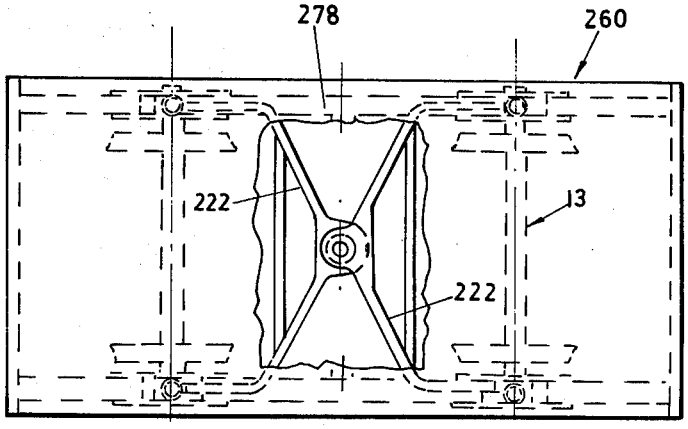
Figure 17:
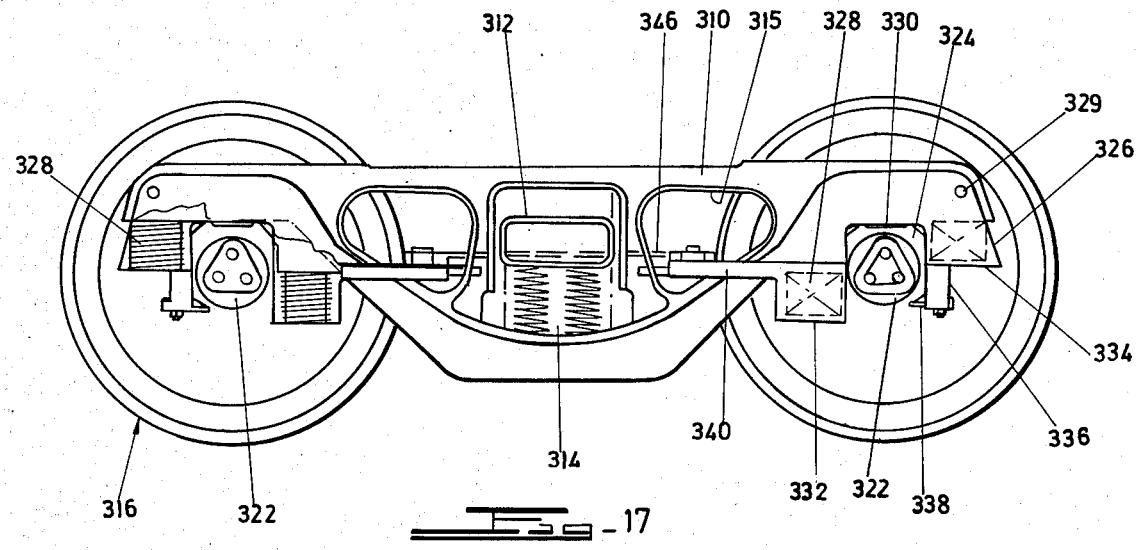
Figure 18:
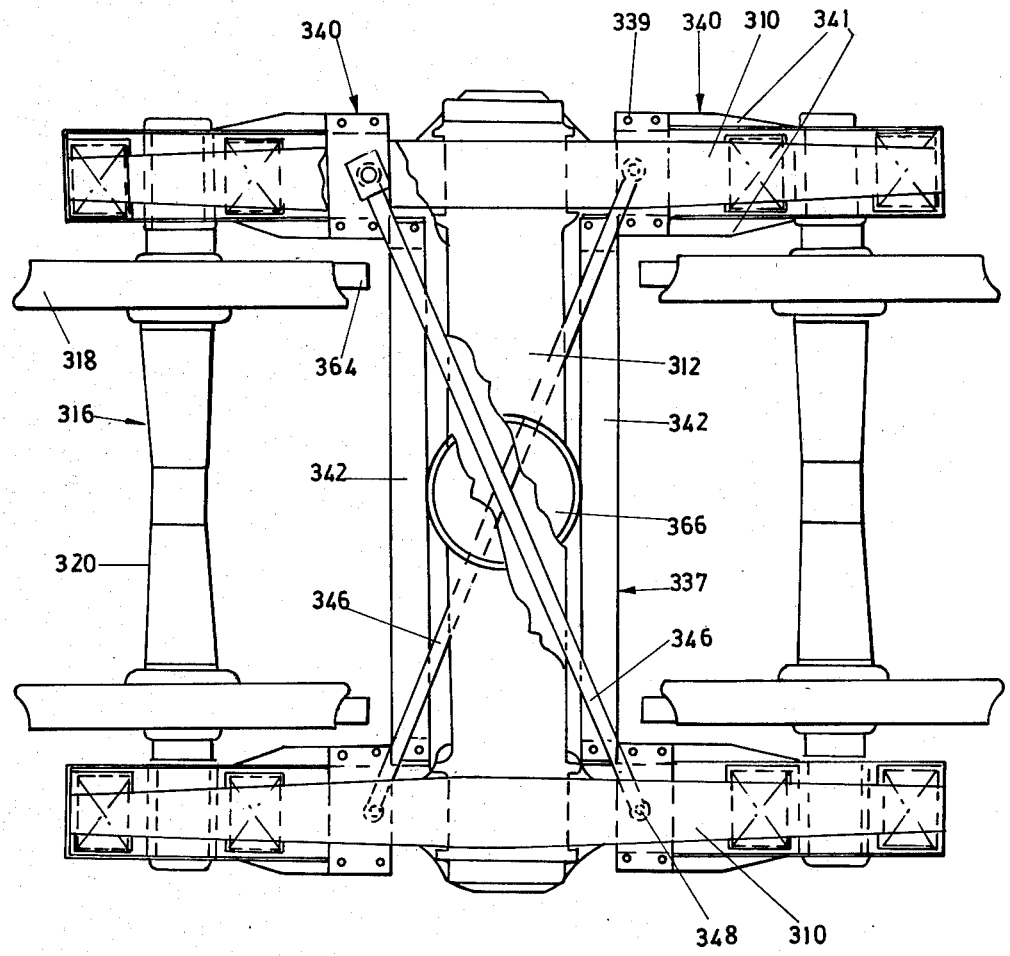
Figure 19:
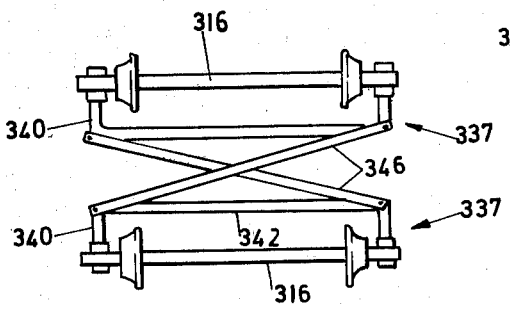
Figure 20:
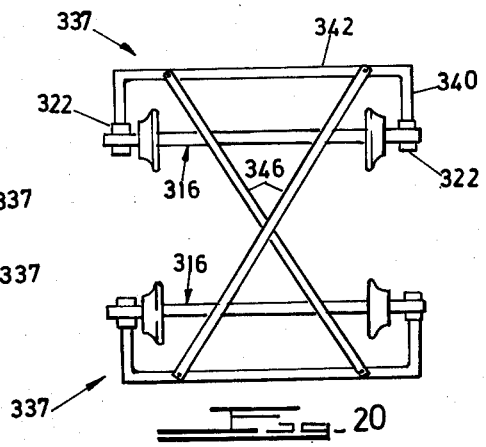
Figure 21:
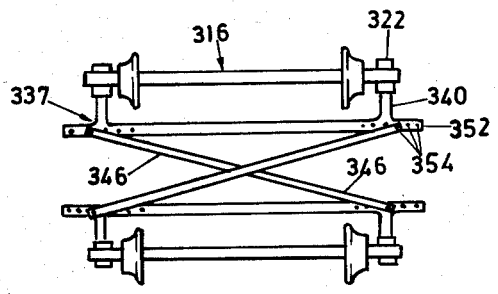
Figure 22:
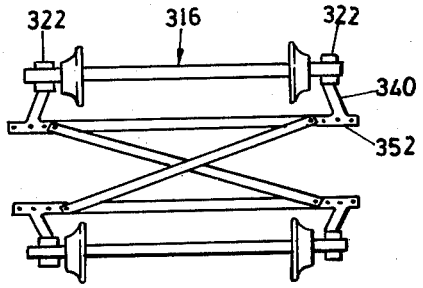
Figure 23:
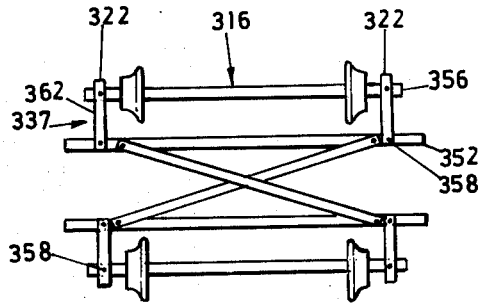
Figure 24:
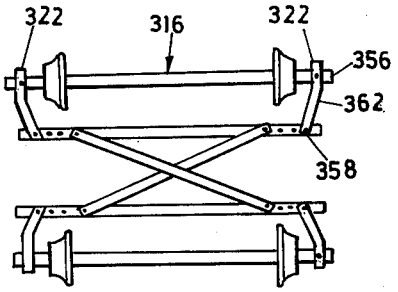
Figure 25:
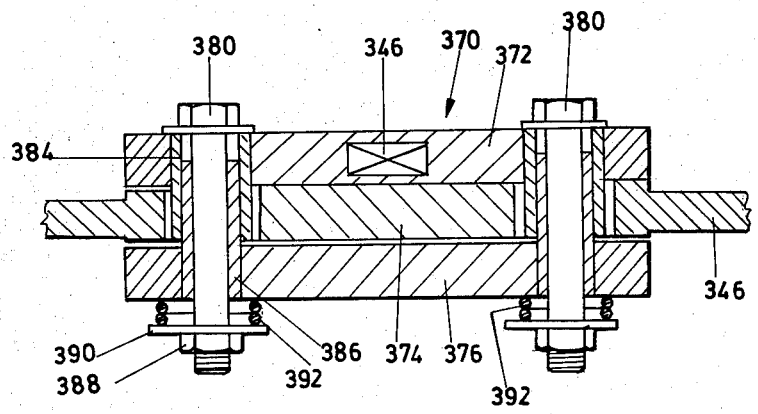
Figure 26:
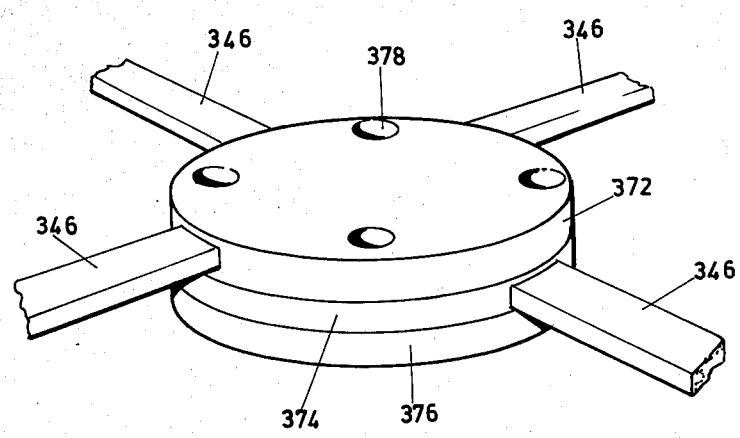
Figure 27:
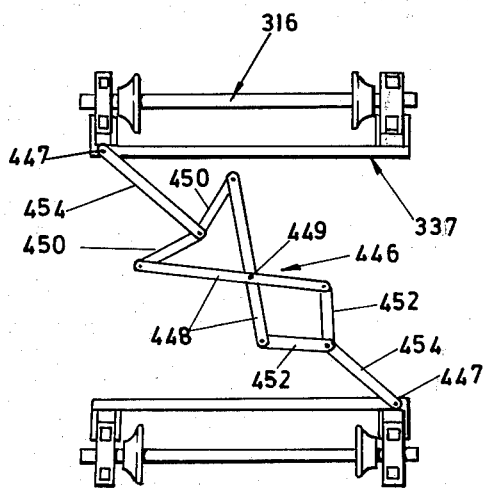
Figure 28:
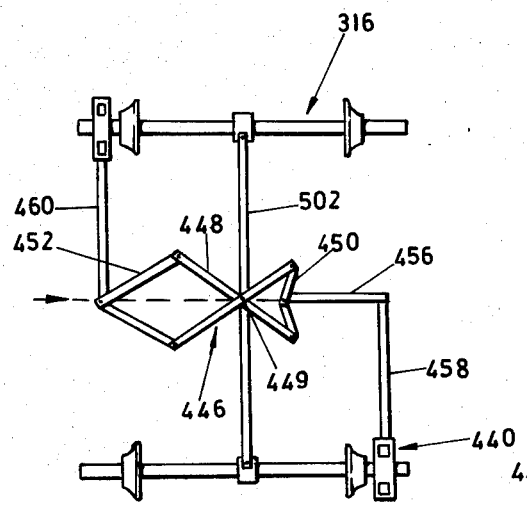
Figure 29:
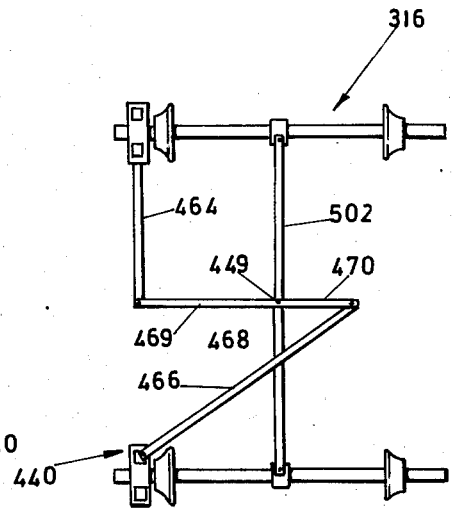
Figure 30:
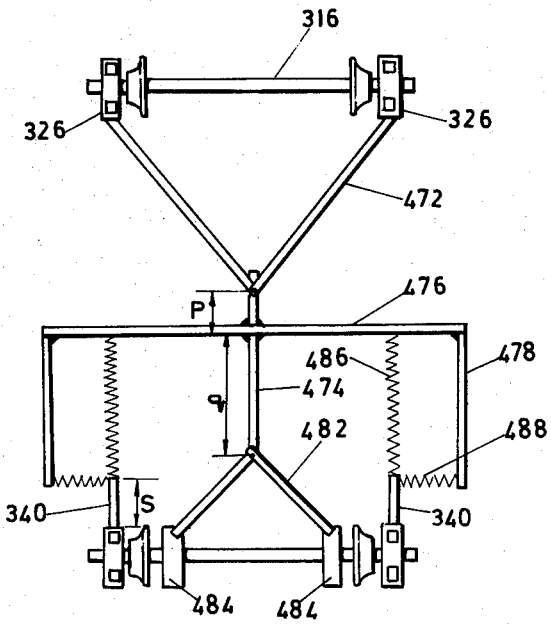
Figure 31:
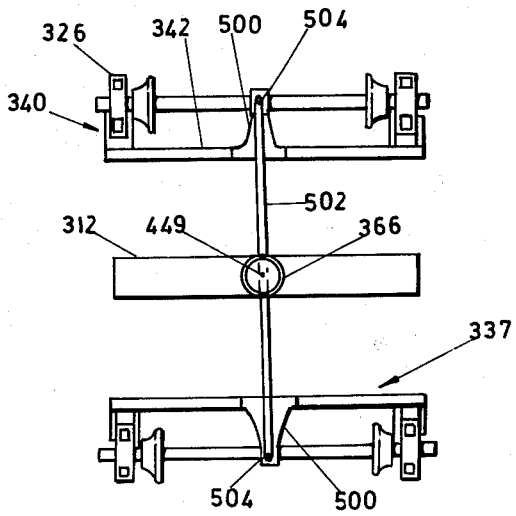

FIGS. 11 and 12 are schematic plan and side views of a third embodiment of a bogie with means for interconnecting yawing movements of a pair of wheelsets in opposite sense, FIGS. 13 and 14 are plan and side views of a Four-Wheeler employing a further variant of interconnecting means, FIGS. 15 and 16 show respectively schematic plan and side views of a three-piece bogie fitted with a further variant of interconnecting means, FIG. 17 is a side elevation with parts broken away of another variant of the truck of the invention, FIG. 18 is a plan view of the truck of FIG. 19 again with parts broken away for clarity, FIG. 19 is a schematic plan view of the truck of FIGS. 17 and 18, FIG. 20 is a schematic plan view of yet another embodiment of railway truck of the invention, FIG. 21 is a schematic plan view of yet another embodiment of a railway truck of the invention, FIG. 22 is a schematic view of yet another embodiment of the railway truck of the invention, FIG. 23 is a schematic plan view of yet another embodiment, FIG. 24 is a schematic plan view of a further embodiment, FIG. 25 is a side elevation in section of a means for damping two rods, which cross each other, relatively to each other, FIG. 26 is a perspective view of the means of FIG. 26 with part removed for clarity, FIG. 27 shows a schematic plan view of a further variant of the truck of the invention, FIG. 28 shows a schematic plan view of another variant, FIG. 29 shows schematically yet another variant, FIG. 30 shows schematically a further variant of the truck of the invention, and FIG. 31 shows schematically a further variant of longitudinal anchor for the truck of the invention.

Figure 1:
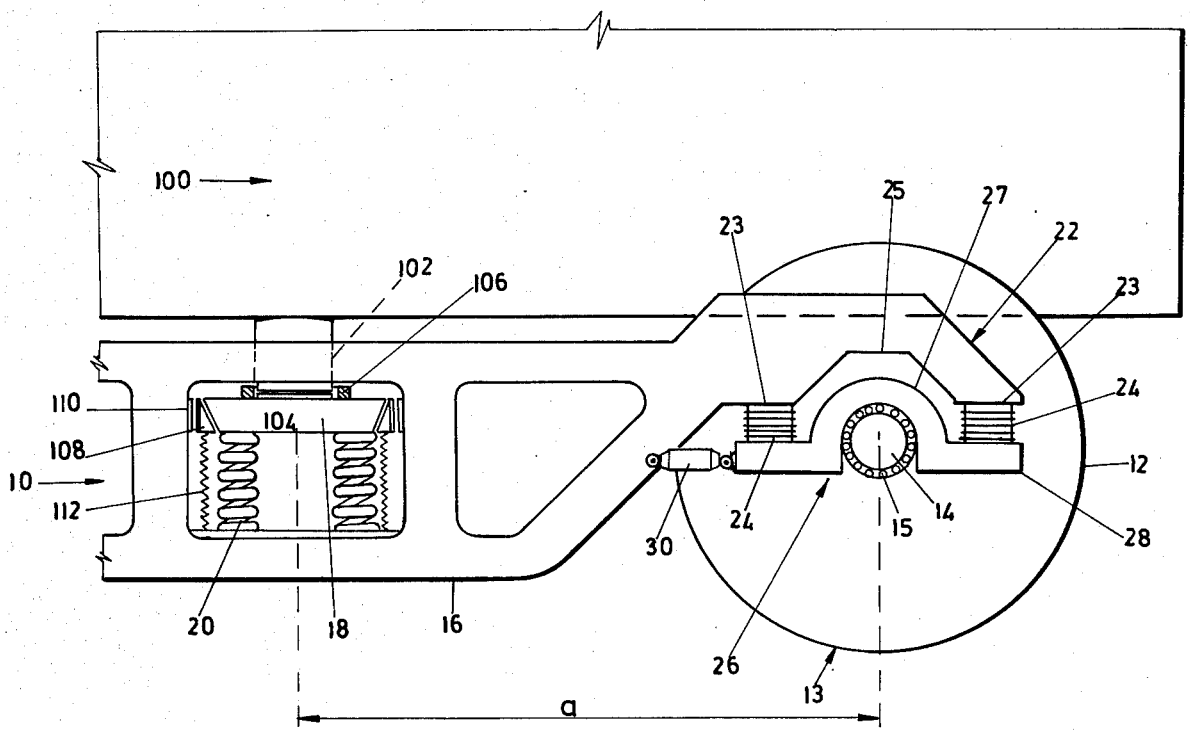
FIG. 1 shows a schematic side view of part of a railway vehicle including a superstructure pivotally mounted on a bogie.

FIG. 1 shows generally a bogie 10 of a railway vehicle having a body 100. The bogie 10 is basically a conventional three-piece bogie comprising two wheelsets 13, side frames 16 mounted on the wheelsets, and a bolster 18 located in the side frames 16 midway between and parallel to the wheelsets. The bolster 18 rests on coil springs 20 and is located longitudinally relatively to the side frames 16 by a known system of wedges 108 and friction plates 110, the wedges 108 being held in position against the bolster by springs 112. This system allows the bolster to move transversely relative to the side frames, the movement being limited by appropriate stops (not shown).

The ends 22 of the side frames have a bridge configuration. The bases of the bridge supports are denoted 23 and 23'. Each base rests on a resilient sandwich element 24 comprising alternate layers of steel plate and rubber pads. The sandwich elements are used because they can be constructed to have low longitudinal and lateral spring stiffnesses. Any resilient element having these properties may also be used, e.g. swing links. The resilient elements 24 are mounted on horizontal flanges 28 provided on an axle box adaptor 26. The adaptors 26 may be of any conventional design provided with additional flanges 28. Each adaptor 26 is mounted on a bearing 15 that is supported on an axle 14 which is rigidly fixed to a pair of wheels 12 to form a "live" wheelset 13. The wheels 12 have "standard wear" profiled treads.

Figure 2:
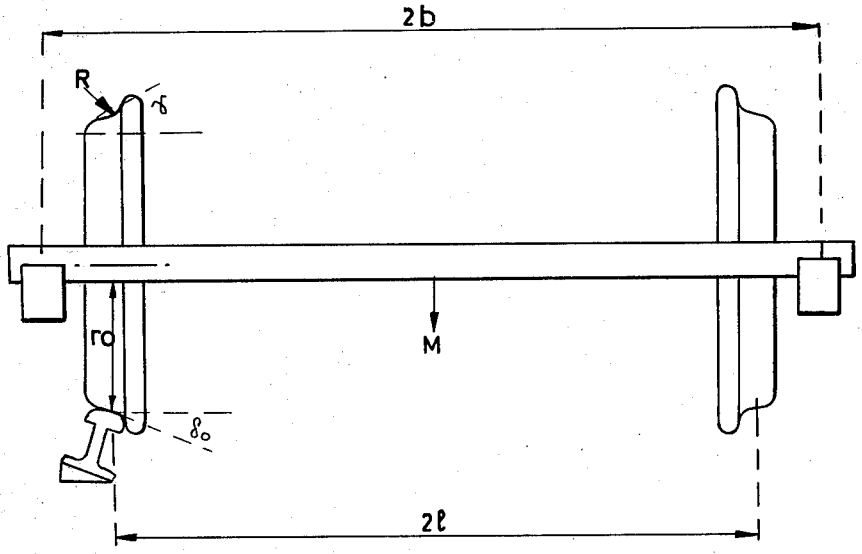
FIG. 2 is a schematic end view of a wheelset illustrating certain dimensions associated therewith.

It should be noted (as shown in FIGS. 1 and 2) that the contact surfaces between the resilient elements 24 and the flanges 28 on the adaptors 26 are on the same horizontal plane passing through the axis of the axle 14. If this is inconvenient from a design aspect then the springs may be spaced from this horizontal plane, but only if one spring is spaced at a certain distance above the plane and the other is spaced at the same distance below the plane. This placement of the contact surfaces is necessary to ensure that there is no moment on the adaptor 26 when the wheelset is in yaw, i.e. there must be rotation of the adaptor 26 about the axle 14.

The resilient elements 24 (of any type) have inherent damping characteristics. In order to increase the damping as well as making it a characteristic which may be selected at will viscous or friction dampers 30 are provided longitudinally and laterally between the side frames 16 and the adaptors 26. A single damper provided angularly may also be used.

The body 100 is mounted on the bogie 10 by means of a female centre pivot 106 having a wear plate 104 on the bolster 18 and a corresponding male pivot 102 which is fixed to the body 100. With this arrangement the bogie is free to rotate with respect to the body.

Figure 3:
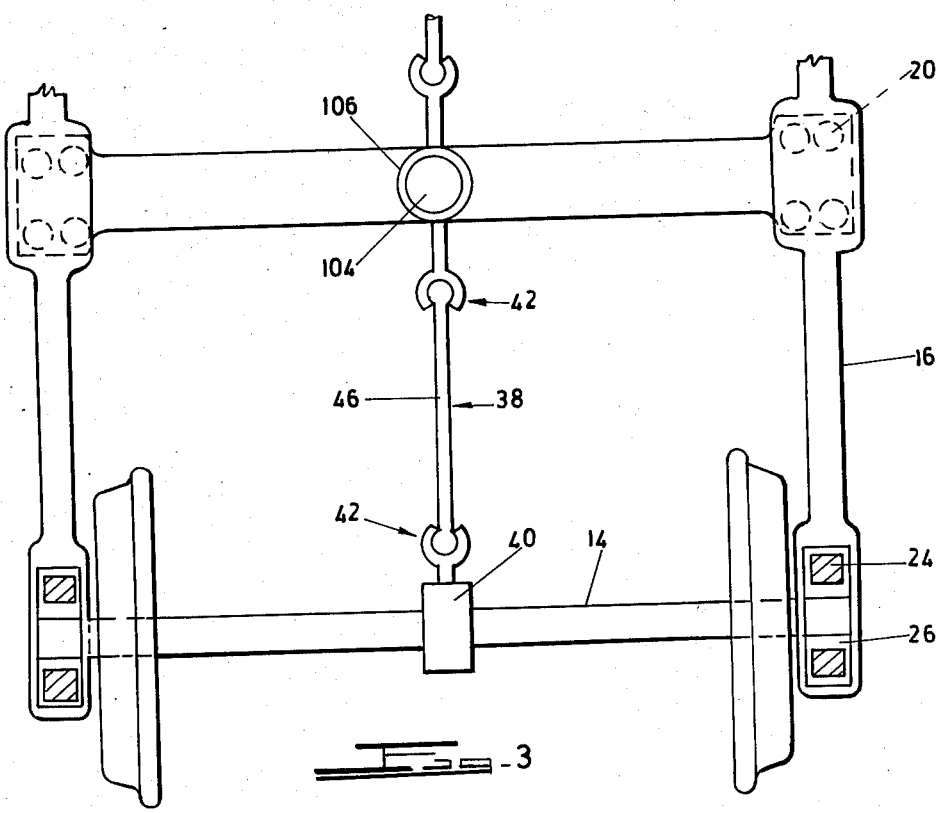
FIG. 3 is a schematic plan view of a bogie fitted with a longitudinal anchor.

FIG. 3 shows a longitudinal anchor 38 between the bolster 18 and the centre of the axle 14. The anchor 38 comprises a bearing 40 mounted over the centre of the axle 14, a ball joint 42 connecting the bearing to a rod 46, and a second ball joint connecting the rod 46 to the bolster 18. Such an anchor does not restrain the axle 14 in yaw, nor against lateral movement if sufficient play is allowed in the bearing 40. The wheelset is restrained by the anchor 38 longitudinally with respect to the bogie and therefore the body, so that even with the soft springing proposed above there is no tendency for the wheelset 13 to move longitudinally with respect to the bogie under high stresses such as heavy breaking or high acceleration.

Figure 4:
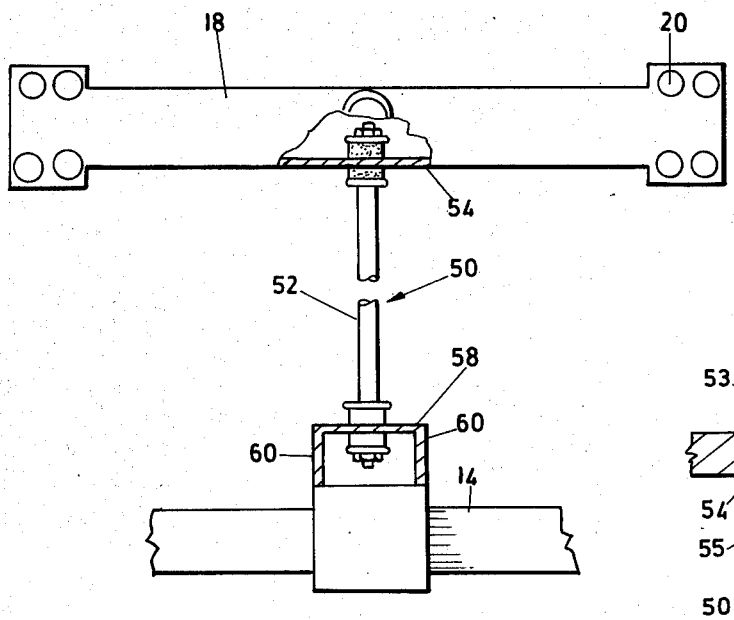
FIG. 4 is a plan view, partly in section, of another embodiment of a longitudinal anchor.
Figure 5:
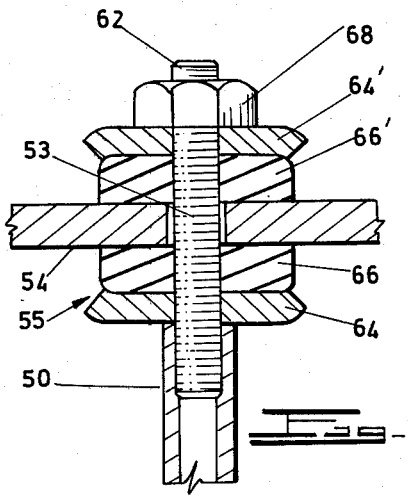
FIG. 5 is a detail of part of the longitudinal anchor of FIG. 4.

FIGS. 4 and 5 show another embodiment of longitudinal anchor 50 comprising tube 52 flexibly connected at one end to a side wall of a hollow bolster 18 and at the other end to a flange 58 supported on an axle-mounted bearing 40 by brackets 60. Each flexible connection comprises a threaded stud 62 engaged with the tube 50, steel washers 64 and 64', rubber "0" rings washers or the like 66 and 66', and a nut 68. This arrangement can be freely adjusted to suit a particular bogie, the dimensions of which might vary by as much as 3cm from a similar bogie.

Figure 6:
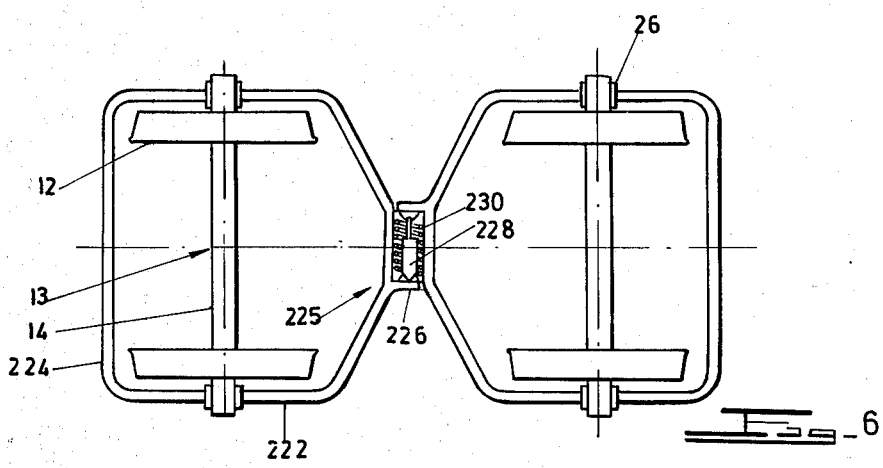
FIGS. 6 and 7 are schematic plan and side views of one embodiment of a bogie with means for interconnecting yawing movements of a pair of wheelsets in opposite senses.
Figure 7:
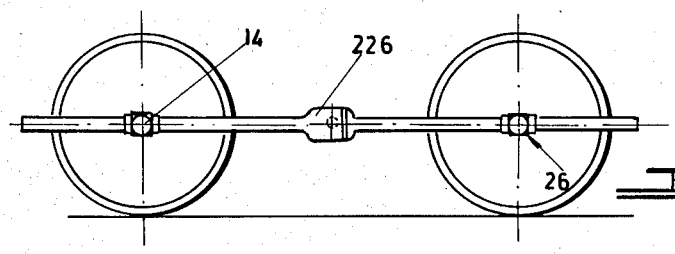

FIGS. 6 and 7 show schematically a portion of a suspension of the invention, particularly a means for interconnecting yawing movements of a pair of wheelsets in opposite sense. The extremities of the axles 14 have axle-box adaptors 26. Solidly secured to the adaptors 26 of each wheelset 13 in a wishbone 222 which may be of a resilient material such as brass, bronze or treated steel. The apices of the wishbones 222 are coupled to each other by an articulation means 225 comprising a flange 226 on each wishbone 222, each flange being off-set from the apex of its wishbone 222, and a viscous or friction damper 228 with a coil spring 230 arranged round the damper 228 connected between the flanges 226. This is not the only possible arrangement however and other resilient and damping elements such as leaf-springs rubber pads or the like in a suitable configuration can be used. Outside each wheelset 13 and attached to the adaptors 26 is a U-shaped member 224 which is provided to reinforce the wishbones 222.

In use, if one of the wheelsets 13 oscillates or yaws about a vertical axis through the centre of the axle, the apex of the wishbone 222 associated with it moves laterally. A portion of this movement is transmitted through the articulation means 225 to the other wishbone 222 and to the other wheelset 13. However, the resilience of the wishbones 222 and the elasticity of the articulation means 225 counteracts the yawing motion by introducing a phase change between the oscillations of the wheelsets 13. Thus, in loose terminology, the responding wheelset 13 also tends to yaw but at a different phase to that of the original yawing motion and, since additional creep forces come into play, the net effect is that wheelset hunting is damped. The wheelsets, in fact, yaw in opposite senses, i.e. 180° out of phase with each other.

The articulation means 225 between the wishbones 222 is such that it can only impose very small turning moments on the wishbones 222 themselves. This means that during cornering the suspension imposes only a minimal rotational constraint on each wishbone 222, and each wheelset 13 is free to follow the curvature of the rails. Therefore each wheelset 13 can attain its optimum attitude for cornering and the suspension has a better steering ability than that of conventional suspensions.

Figure 8:
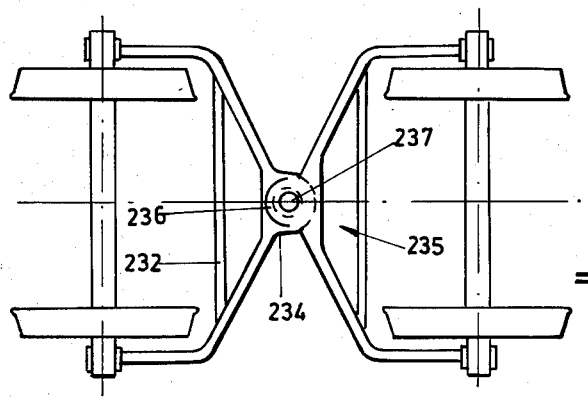
FIGS. 8 and 9 are schematic plan and side views of a second embodiment of a bogie with means for interconnecting yawing movements of a pair of wheelsets in opposite senses.
Figure 9:
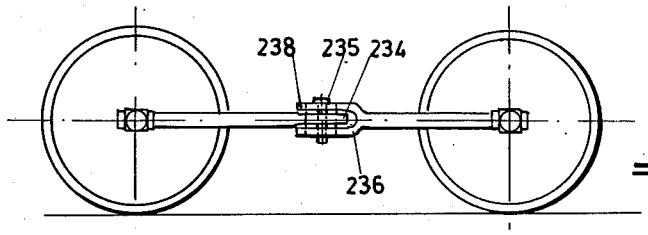

FIGS. 8 and 9 show a suspension in which a transverse beam 232 is provided for strengthening the wishbone 222. An articulation 235 between the wishbones 222 is a pin joint comprising a flange 234 provided at the apex of one of the wishbones 222, a flange or spaced flanges 236 provided on the other of the wishbones 222, and a pin 237 passing through registering holes in the flanges 234 and 236. A rubber sleeve or bush 238 is arranged around the pin 237. The bush 238 provides additional lateral resilience for the wishbones 222.

In operation, this suspension is similar to that of the embodiment of FIGS. 6 and 7 except that the articulation means 235 has a definite pivot point, that is the pin 237. Thus, when the vehicle negotiates a curve the apices of the members 222 move in the same direction laterally and there are no moments in the articulation means 235 since the movement is purely rotational about the pin 237. By selection of the composition and configuration of the rubber bush 238, the suspension can be "tuned" to obtain optimum wheel set hunting stability as will be appreciated by persons skilled in the art.

An alternate embodiment of articulation means 295 which can be used between the wishbones 222 is shown in FIGS. 10 and 10*a*. The articulation means 295 comprises a small channel section 290 and a large channel section 291. Each of the sections 290 and 291 is secured to one of the wishbones 222 and provision is made for spacers 292 to be interposed between each section, 290, 291 and its corresponding wishbones 222. The sections 290 and 291 are arranged to overlap longitudinally and are connected by rubber pads 293 and 294 which are vulcanised onto the inside of the larger section 291 and the outside of the smaller section 290 as shown in FIG. 10*a*, i.e. between each of the opposing faces.

This articulation means 295 is simple and inexpensive to manufacture, is durable and has the required properties of resilience and minimal moment transmission. Furthermore the articulation means can be used as a standard item together with standard size wishbones since the provision of spacers allows for the assembled system to be adapted to variations in bogie side frame length. Of course, with any of the other arrangements spacers can be included at suitable points, e.g. at the articulation means or at the adaptors 26.

FIGS. 11 and 12 show an embodiment in which the wheelsets 13 are coupled by two links 244 which cross each other. Each link 224 extends from an adaptor 26 of one wheel set 13 diagonally to an adaptor 26 of the other wheelset 13. The ends of each link 244 are coupled to the adaptors 26 using pin joints 246 arranged such that the links can pivot in a substantially horizontal plane. One of the links 244 has a slot 248 formed in it at approximately halfway along its length, the slot 248 being sufficiently wide to allow the other link to pass through it. An alternative to this arrangement is to crank one or both of the links 244 near where they cross. Each of the links 244 may have resilient and/or damping means 250 in parallel with it; the means 250 shown in the drawing comprises a coil spring 252 in parallel with a viscous damper 254. However, any other convenient means such as rubber pads, cranked leafsprings or the like may be used. Further, the links 244 have been shown as symmetrical, but this need not necessarily be so.

While not shown in any of the drawings it is also possible to form the links 244 integral with the adaptors 220, i.e. either during casting or subsequently by welding or the like. In such a situation the links 244 need to be laterally flexible and this may be attained by suitable choice of the material used (e.g. bronze) and/or by cranking the link 244 so that it is resilient at the bends.

In operation if one of the wheelsets 13 pivots or oscillates then obviously one of its wheels 12 will move towards and the other wheel 12 away, from the centre of the suspension. The wheel 12 which moves towards the centre causes the wheel 12 of the other wheelset 13, to which it is diagonally connected, to tend to be pushed away from the centre, and conversely for the wheel 12 which originally moves away from the centre. Because of diagonal links 244 couple yawing movements of the wheelsets in opposite senses a similar damping of wheelset hunting as described previously occurs. During cornering both wheelsets 13 follow the curvature of the rails, because there is no or little yaw constraint on the wheelsets 13 caused by using the independent diagonal links 244 and any constraint arises from other suspension elements.

To sum up the characteristics of the couplings between a pair of wheelsets described so far the following should be noted:

a. for all the embodiments which show and describe symmetrical couplings it is also possible to dispense with one half of the coupling to leave, e.g. one link 244 or one arm of a wishbone 222 fixed to an adaptor 26 so that it cannot pivot laterally;

b. the arms of the wishbones 222 may be formed integrally with the adaptors 26;

c. the resilient and/or damping means 250 is parallel with the links 244 or the other resilient and damping means 228, 238, 230 can be dispensed with if there is sufficient elasticity in the materials used to form the wishbones 222 or links 244. The materials also have inherent hystersis damping. Thus, by selecting the composition of the materials used and the dimensions of the wishbones 222 or links 244 the required paramaters for counteracting hunting can be obtained; and d. the coupling in all embodiments is used as a hunting stabilizer and is unstressed during curving. This is in contrast to prior art couplings which are, in fact, "steering arms" and are used to force the wheelsets into the correct radial position on curved track. Such steering arms as described in French Pat. No. 1,006,038 Maschinenfabrik Esselen and German Pat. No. 876,249 Dr. Ing. G. A. Gaebler are rigidly constructed as they have to withstand large forces, because the wheelsets cannot steer themselves, and they in no way serve as hunting stabilizers.

FIGS. 13 and 14 show a Four-Wheeler 260 provided with articulated wishbones 222. The Four-Wheeler comprises a body 261 resiliently supported by a "swing link" mounting means 262 on two wheel sets 13. Each mounting means 262 comprises an axle guide 264 pivotally coupled by swing links 266 to a housing 270, which in turn is resiliently supported on an adaptor 220 by a coil spring 268 (a rubber pad or a sandwich element may also be used.)

Laterally between the housing 270 and the axle guide 264 there is a clearance so that the wheelsets can move longitudinally in the axle guides. The clearance may be of the order of 3 to 15mm ($\frac{1}{8}$ to $\frac{7}{8}$ inches).

In operation, a number of advantages accrue from using the mounting 262. Firstly, the clearance ensures that the steering ability of the wheelsets 13 is not interfered with by the vehicle body 261 especially during cornering. The precise clearance is selected according to the vehicle wheelbase and the sharpest curves to be negotiated. Secondly, the use of the swing links 266 and springs 268 ensures that there is little longitudinal restraint or stiffness on the wheelsets 13. This can be done since suppression of wheelset hunting is no longer dependent on the stiffness of the suspension elements 266 and 268. The spring characteristics of the suspension can be selected to provide optimum riding quality and steering ability.

FIGS. 15 and 16 show schematically parts of a three-piece bogie 10 having two side frames 16 and a bolster 18. In contrast to some of the previous embodiments using wishbones 222 there are provided W-shaped members 286 in which the free ends of the members are bent so that they pass around the outside of the wheels so that the members 286 only occupy a minimal space in the interior of the bogie. Furthermore (as illustrated in FIG. 16) the arms of the members are cranked vertically so that they can pass over the axles 14 and also so that the centre of the pin joint between the members 286 lies in substantially the same horizontal plane as the axles 14. A feature which is shown in FIG. 15, but which can be applied to any of the embodiments is that the flanges of the pin joint between the members 286 are formed with a longitudinal slot 288 to allow greater longitudinal freedom between the members 286 while still being able to provide the same properties as the aforementioned embodiments.

A resilient coupling between the wheelsets 13 and the bogie side-frames 16 as shown in FIG. 16 includes a rubber sandwich element 290 having a low shear stiffness, located vertically between the side-frames 16 and the adaptors 220. Again a clearance is provided between the adaptors 220 and the axle-guides 283 and 283' formed at the ends of the side frames 16.

FIGS. 17 to 19 of the drawings show a three-piece bogie including two side-frames 310 and a bolster 312 supported by coil springs 314 on the side-frames 310. The bolster is essentially of a hollow, elongate box construction. The side-frames 310 rest on two wheelsets 316 each comprising a pair of wheels 318 fast or solidly mounted on an axle 320. The axle rotates in bearings 322. Each bearing 322 is connected to a side-frame 310 by a pad 324 having an arcuate lower surface which rests on the bearing 322, an adaptor 326 which rests on an upper surface of the pad 324, and two rubber sandwich elements 328 which are mounted on the adaptors 326 and which in turn support the side-frames 310. Each rubber sandwich element 328 comprises alternate layers of rubber and metal plate. The bolster has a conventional female wear plate 366 for pivotally supporting a superstructure.

Each adaptor 326 is channel shaped in cross-section and comprises a web 330 which rests on a pad 324 and two horizontal supports 332, 334 on opposed sides of the web 330 so that the supports straddle a bearing 322. A depending flange 336 is secured to the support 34 to provide a mounting for a key 338 which prevents the bearing from being separated from the adaptor to the side-frame in the event of gross relative movement. The supports 332, 334 of the adaptor are equally spaced from the horizontal plane passing through the axis of the axle 320, with the supports 332 being located below and the support 334 being located above the horizontal plane. This ensures that when forces are applied to the adaptor it does not rotate in a vertical plane. The pad 324 may be welded to the bearing, alternatively the pad 324 may be a snug fit between the walls of the adaptor 326 which straddle the pad 324.

The wheelsets of the truck are interconnected to couple their yawing movements in opposite senses by a coupling which comprises a U-shaped extension member 340 secured to each adaptor 326, a beam 342 connected between the free ends of the extension members on a wheelset to form with the extension members a sub-frame 337 on the wheelset, and two rods 346, which cross each other, pivotally connected to the sub-frames 337 by pin joints 348. Each extension member comprises a plate 339, which passes through a hole 315 conventionally formed in the side-frame 310, and struts 341 which secure the plate 339 to the sides of the adaptor 326. The beam 342 is connected to the plates 339 of the extension members 340. The rods 346 pass through slots in the bolster, the slots being sufficiently wide and deep to ensure that the rods do not contact the bolster on relative movement of the rods and the bolster to one another. The beam, inter alia, acts to prevent significant convergence or divergence of the extension members when the wheelsets move longitudinally relatively to each other.

Single-acting brakes 364 are provided for each wheel. Brake beams and the like for the brakes have not been shown.

Each wheel has a profile, i.e. does not have a straight taper, and the profile is such that the wheel has a high effective conicity which is greater than 1/20. The elastomeric elements 328 impose a yaw constraint on the wheelsets which is sufficiently low to permit each wheelset to attain a radial position in a curve. The relationship between the wheel tread conicities and the yaw constraints of the element 328 is such that each wheelset is substantially self-steering in the curves in which the truck is to be used. The yaw constraint given by relationship (4) is the preferred or optimal value, but higher yaw constraints still within the limit given by relationship (2) may be used for practical considerations, e.g. construction of the elastomeric element 328.

The diagonal interconnection is resilient between the wheelsets, the elasticity being in the range from $3 \times 10^6$ N/m to $3 \times 10^7$ N/m ($1.7 \times 10^4$ to $1.7 \times 10^5$ lbf/in). This elasticity is essential for the coupling between the wheelsets to act as a hunting stabilizer. If sufficient elasticity cannot be obtained from the materials of the rods or anchors 346, then rubber or other types of elastomer may be provided at the pin joints.

The structure of FIGS. 17 to 19 is more practical in terms of total cost, manufacturing requirements and adaptation to existing or conventional bogies than the structures described previously. For example the wheelsets are interconnected by rods 346 which may be solid, tubular or any other section, which rods 346 are simply pin-joined to the subframe 337 of the wheelsets 316. Each sub-frame 337 is constructed of simple-section beams 342, plates 339 and angle iron 341. The adaptors 326 are cast or formed from welded plates. These simple components should be compared with with the construction of wishbones or Bissell frames 222 or limbs 244 integral with the adaptors 26 described previously. The coupling between the wheelsets is easily adaptable to any type of three-piece bogie. For example the plates 339 of the extension members 340 pass through the holes 315 conventionally formed in the side-frames 310, and the rods 346 pass through slots simply cut into a conventional bolster (these slots are conventionally formed in the bolster 312 to accommodate brake rods).

In addition to the constructional advantages, the inventor has found that the couplings of FIGS. 17 to 19 provides additional hunting stabilation for a truck over the coupling of the previously described embodiments. If one considers the coupling means to be a gear which transmits moments and forces between the interconnected wheelsets and the "mechanical efficiency" of the gear for transmitting moments and forces is termed to be E, then it can be shown mathematically that the forces which tend to stabilize hunting for one wheelset will be proportional to $(1 + E)$ and for the other wheelset will be proportional to $(1 - E)$. Thus, if the efficiency E is very high and approaching one, such as may be obtained with the couplings of FIGS. 6 to 16 then it can be seen that the stabilizing force on one wheelset will be high and on the other wheelset will be minimal. If, however, the gear is made "inefficient", i.e. E is low, then both wheelsets receive significant, but different stabilizing forces. This has a net stabilizing effect which is greater than when the gear is very efficient. The forces and couples on the wheelsets obtained through the coupling means cause stabilizing creep forces to be generated in the contact areas between the wheels and the track and such stabilizing-creep forces are enhanced because each wheelset does not turn about its centre of gravity, but about a point on the beam 342.

The efficiency for transmitting moments of the diagonal interconnection can be adjusted by changing the direction in which the extension members project (i.e. the inclination of the extension members to the longitudinal axis of the truck), the lengths of the extension member or the positions of the pivotal connections of the rods 346 to the sub-frames 337. Normally the pad 324 is a close fit in the sub-frame 337 or it may even be welded or wedged in place. Now, it has been found that a lower efficiency and therefore a higher hunting stability can be obtained if the pad 324 is a loose fit so that the adaptor 326 and pad 324 can slide and rotate relatively to each other with a resultant loss of energy and lowering of transmission efficiency. A clearance of about 2 to 5mm (5/64 to 1/5 inch) has been found to be sufficient. The interfering surfaces of the pad 324 and adaptor 326 should be such that they can rub against each other. The frictional force between the rubbing surfaces of the pad and adaptor is dependent on the vehicle load. With this construction the adaptor 326 can be considered to be pivotally connected to the wheelset.

Since the coupling between the wheelsets itself can now be made to be effective for stabilizing hunting, the elastic constraints on the wheelsets relative to the truck can be decreased to allow each wheelset greater freedom to yaw in a curve since these elastic constraints are no longer the sole means of damping wheelset hunting. The elastic constraints may even in appropriate situations, as will be appreciated by persons skilled in the art, be reduced to zero.

The efficiency of the diagonal interconnection can be tailored to "tune out" or avoid resonance like instabilities of the bogie and body mounted on the bogie.

FIG. 20 shows schematically a truck having a construction similar to that of FIGS. 17 to 19, but with the sub-frame 337 located outside the wheelsets 316 of the truck.

FIGS. 21 to 24 show various constructions of couplings between a pair of wheelsets which can be used for varying its mechanical efficiency for transmitting moments and forces and thus its hunting stabilizing effect on the truck.

In FIG. 21, the sub-frame 337 on each wheelset is formed by extension members 340 and a beam 352 fixed to the extension members. The beam 352 differs from the beam 342 in that it projects beyond the extension members 340. Holes 354 for receiving the pin of a pin joint are formed in the beam 352. The rods 346 can be pivotally joined to the beam 352 at any of the holes 354, the four holes 354 being used being symmetrical relatively to the truck.

FIG. 22 shows a variation of the diagonal interconnection of FIG. 21 in which the extension members 340 are inclined relatively to the longitudinal axis of the truck.

In the constructions of FIGS. 19 and 22 each extension member 340 is secured to the wheelset so that it can transmit moments to that wheelset. For this reason the beam 342 or 352 on each wheelset may be omitted without changing the effectiveness of the diagonal interconnection.

In a modification of the embodiments of FIGS. 19 to 22 and beam 342 or 352 may be pivotally connected to its extension members 340 by means of pin-joints, rivets or welding. This construction has particular advantage in the embodiments of FIGS. 19 and 22 in which the extension members 340, beams 342 and rods 346 can be interconnected by a single pin-joint or the like.

FIG. 23 shows a variation of the construction of the subframe 337 in which each extension member 340 is pivotally connected at 356 to a bearing of a wheelset and is also pivotally connected at 358 to the beam 352. The pivotal connections 356 and 358 can be pin joints, rivetted joints or the like which permit a small amount of relative pivotal movement. The pivotal connection 356 is over the centre of the bearing 322 so that each extension member is rotatable about a vertical axis passing through the centre of the bearing 322.

The pivotal connection 356 between each extension member 340 and its bearings 322 can be formed by making the pad 324 rotatable relatively to the adaptor 326 with the extension member 340 secured to the adaptor 326 as described before.

In FIG. 24 there is shown a variation of the diagonal interconnection of FIG. 23. In this embodiment each extension member 340 is connected to its beam 352 in such a manner that it lies inclined relatively to the longitudinal axis of the truck. In this event, if one wheelset 316 moves laterally relatively to the other wheelset 316, then because of the interconnection of the sub-frames 337 the wheelset moves, in effect, laterally relatively to its beam 352. This causes one of the extension members 340 to push the ends of the wheelset 316 and beam 352 closest to it away from each other and the other extension member 340 to pull that end of the beam and wheelset together. This forces the wheelset into a position where stabilizing creep forces are generated in the contact areas between the wheel and the track.

With the embodiments of FIGS. 22 and 24, the extension members 340 can either project outwardly or inwardly of the truck.

The inventor has also found that it is desirable to damp the rods 346 relatively to each other so that the transmission efficiency of the coupling means is further lowered. In FIGS. 25 and 26 there is shown a means 370 for damping the rods 346 relatively to each other. The damping means 370 comprises a first plate 372 secured to one of the rods 346, a second plate 374 secured to the other of the rods 346, and a third plate 376 connected to the first plate 372 so as to interpose the second plate 374 between itself and the first plate 372. Each of the plates 372, 374 and 376 have four through-holes 378 which are in register, the holes in the second plate 374 being of larger diameter than the holes in the first 372 and third 376 plates.

Bolts 380 pass through the holes. In order to ensure a good sliding fit of the bolts 380 in the holes 378 a brass or Nylon bush 384 passes through each hole in the first plate and extends towards the third plate 376. A bush 386 of smaller diameter and slidable axially in the bush 84 is inserted through the bush 384. The bush 386 is a snug fit around the bolt 380 and is connected to the plate 376. A nut 388 and washer 390 is engaged with each bolt 380 with a spring 392 being provided between the washer and the third plate 376.

In use, each nut 388 is tightened onto its bolt 380 to compress the spring 392 and prestress the first and third plates together. The rods 346 are permitted a small amount of relative movement, both rotational and sliding, because of the large clearance holes in the second plate. Any movement is frictionally resisted by the rubbing of the second plate against the first and third plates.

A single bush may also be used in place of the telescopic bushes 384, 386. In this event the bush would be secured to the plate 372 and would be a sliding fit in the plate 376. Thus the plate 376 would be movable towards and away from the plate 372, but would be guided laterally relatively to the plate 372.

As is known, hunting stability is at its worst in railway vehicles which are lightly loaded or empty. For this reason the prestress imposed by the compression of the spring 392 is selected for optimum hunting stability of the vehicle when it is lightly loaded.

In the just described embodiments the bearings 322 are located outside the wheels. The bearings may, of course, be located between the wheels of a wheelset, i.e. "inboard", with the extension members still being connected to the bearings.

While it is most convenient to attach the extension members 340 to the adaptor 386 and bearings 322 which support the load-bearing members, such as side-frames of a bogie or the body of a Four-Wheeled vehicle, the extension members may be connected to separate bearings provided specifically for that purpose. In a vehicle in which the wheelsets are driven by an electric motor mounted on bearings on the wheelset, then the extension members may be connected to the casing of the motor.

A further variant of the invention, several embodiments of which will be described below with reference to FIGS. 27 to 30, involves providing a coupling or interconnecting means that transmits different forces and couples between the wheelsets i.e. when considered as a gear it has a transmission "ratio" which is not unity. An example of different forces and couples transmitted between the wheelsets is one in which a pure rotation of one wheelset is transmitted to the other wheelset as a couple tending to make the other wheelset also rotate (but in the opposite sense) and a force tending to move the wheelset laterally. Another example is one in which a rotation of one wheelset is transmitted to produce a smaller rotation of the other wheelset in the opposite sense.

With such a coupling or interconnecting means the effect of say a longitudinal creep force inducing hunting of the wheelset is transmitted to the responding wheelset to generate both longitudinal and lateral creep forces.

These generated creep forces on the responding wheelset are stabilizing and tend to inhibit movement of the responding wheelset which in turn is felt by the actuating wheelset as a reaction tending to reduce the effect of the original hunting-inducing longitudinal creep force. Similar effects would be exhibited for other hunting inducing-creep forces. The actuating and responding wheelset will alternate during different parts of the oscillations of the wheelsets.

In FIGS. 27 to 30 the parts of a railway vehicle, i.e. the essential features of a coupling or interconnection between a pair of wheelsets there shown are fitted to a bogie of the type shown in FIGS. 17 and 18. For this reason reference numerals already used in connection with the FIGS. 17 and 18 embodiment will be retained.

In FIG. 27 the wheelsets 316 are interconnected by a set of linkages 446 to couple their yawing movements in opposite senses. The set of linkages 446 are connected by pin joints 447 to the sub-frames 337 on the wheelsets. The set of linkages 446 pass freely through a hole in the bolster 312 (not shown).

The set of linkages 446 is essentially a scissors arrangement comprising two levers 448 pivoted on each other about a pin 449, a linkage 450 connected to one end of each lever 48, a linkage 452 connected to the other end of each lever 448, and rods 454 connected to the free ends of the linkages 450, 452 and to the sub-frames 337 on the wheelsets 316. The linkages 450 extend from the ends of the levers 448, to which they are pivoted, inwardly towards the pin 449 joining the levers 448. The levers 452 extend outwardly from the levers 448. The lengths of the levers 450 and 452 are different and the angles they subtend with the levers 448 and with each other are also different; this is obvious from the geometry of the arrangement.

This interconnection between the wheelsets 316 is unsymmetrical geometry ensures that the forces and couples experienced by either wheelset as a result of the interconnection between them are different; in this sense the interconnection may be termed to be "inefficient". The discussion relating to "inefficiency" in connection with the embodiments shown in FIGS. 21 to 24 is also applicable to this embodiment and to those shown in FIGS. 28 to 30.

In practice it has been found that the best results are achieved if the fulcrum 449 is fixed at the centre of gravity or symmetry of the truck.

FIG. 31 shows schematically a longitudinal anchor arrangement for use with the bogie of FIGS. 17 and 18 both to locate the wheelsets longitudinally relatively to each other and for mounting the pin 449 so that it is fixed relatively to the bogie as a whole. A sub-frame 337 as described previously is secured to each wheelset 316.

A strut 500 extends from each beam 342 of each sub-frame 337 to its associated wheelset so that the strut 500 passes over the axle of the wheelset. An anchor 502 is pivotally connected at each of its ends 504 to the struts 500, each pivotal connection being directly over the centre of gravity of a wheelset. The anchor passes through slots conveniently formed in the bolster 312 for fitting brake rods. With this arrangement the anchor 502 does not interfere with rotation of each wheelset about its centre of gravity, but does serve to restrain them longitudinally relatively to each other. The pin 449 for pivotally connecting the levers 448 of FIG. 27 is fixed to the anchor 502. The pin should not be fixed to the bolster as would appear to be convenient, because lateral movement of the bolster 312 relatively to the wheelsets 316, say as a result of a lateral body movement, would cause the wheelsets to yaw in a hunting destabilizing manner.

For passenger vehicles where riding quality and safety are very important and for locomotives where traction forces are high then the anchor arrangement is also connected to the vehicle mass. This is accomplished by pivotally connecting a further anchor (not shown) between the bolster 312 and the strut 500 at 504. The body is connected laterally and longitudinally to the bolster 312 through its pivot 366.

In FIG. 28 a set of linkages 446 similar to that of FIG. 27 is shown, the set of linkages 446 having its axis A parallel to the wheelsets. An arm 456 that transmits moments to one wheelset 316 is connected between the linkages 452 on one side of the set of linkages 446 and that wheelset. An arm 460 that transmits moments to the other wheelset 316 is connected between the linkages 452 on the other side of the set of linkages 446 and that wheelset. The pin 449 for coupling the levers 448 of the set of linkages 446 is supported on the anchor 502.

In FIG. 29 the wheelsets 316 are interconnected by arms 565 and 466, each pivotally connected at one end to a wheelset 316, and connected to each other by a lever 468 which is pivoted at 449 on an anchor 502. As shown the lengths of the lever arms 469, 470 of the lever 468 that are connected to the arms 464, 466 respectively are different so that the forces transmitted between the wheelsets by the diagonal interconnection are different. In addition the arm 466 is inclined relatively to the longitudinal and transverse axes of the bogie.

Thus pure rotation of the wheelset 316 connected to the arm 464 causes the other wheelset also to rotate (but in the opposite sense) and to move laterally. Hence it can be seen that a longitudinal creep force on one wheelset 316 induces longitudinal and transverse creep forces on the other wheelset.

In order pivotally to connect the arms 464, 466 to their respective wheelsets 316 the adaptor 326 arrangement shown in FIGS. 17 and 18 is modified. Essentially the pad 324 is made smaller than the inside cross-section of the adaptor 326 so that the adaptor 326 and pad 324 can slide and rotate relatively to each other. A clearance of 2 to 5mm (5/64 to 1/5 inch) has been found to be sufficient.

The arms 464, 466 are connected to the pads 324. This construction has an added advantage that it provides damping or energy dissipation through frictional loss of the adaptor 326 and pad 324 rubbing against each other.

In FIG. 30 the means interconnecting the wheelsets in opposite senses includes a wishbone 472 connected to the adaptors 326 on one wheelset 316, a wishbone 482 connected to axle-mounted bearings 84 on the other wheelset 316, and a linkage 474 connected between the apices of the wishbones 472, 482. A cross-member 476 is solidly secured to the linkage 474 at a point aligned with the centre of gravity of the bogie. Arms 478 that are parallel to each other extend from the ends of the cross-member 476. The cross member 476 and its arms 478 are resiliently connected to extension members 340 by longitudinal springs 486 and lateral springs 488. The transmission "efficiency" and "ratio" of this interconnection is determined by the stiffnesses of the spring 486, 488 and the lengths *p,q,* and *s* shown in the drawing. Torsion bars suitably connected can be used in place of the springs 486, 488.

A simplification of the embodiment of FIG. 30 comprises replacing the lateral springs 488 by a torsion bar secured vertically to the beam 476 and extending towards the small wishbone 482. Suitably the small wishbone is a sub-frame 337 as described previously with a bracket being provided to secure the free end of the torsion bar to it.

In all embodiments described above a single means for interconnecting wheelsets to couple their yawing movements in opposite senses has been shown and described.

This can be duplicated with each of the interconnecting means being unsymmetrical or previously described.

In all the embodiments of FIGS. 27 to 30 changing the lengths of the various levers, lever arms or linkages will change the transmission "efficiency" and "ratio" of the interconnecting means.

These structures of FIGS. 27 to 30, of course, can also be fitted to "Four-Wheelers" and to traction vehicles.

I claim:

1. A railway truck comprising at least two live wheelsets each having a pair of spaced wheels solidly mounted on an axle; axle supported bearing means adjacent each wheel; load-bearing means for distributing truck load forces to each bearing means; the truck being characterized by each wheelset being self-steering in that its wheels each have a profiled tread of high effective tread conicity to obtain a differential effect between the wheel diameters of the outer and inner wheels on curved track; elastic constraint means; supportingly positioned between the load-bearing means and each axle supported bearing means, and providing elastic constraints to relative lateral and yawing movement between each wheelset and the load bearing means wherein the forces of elastic constraint on each wheelset are lower than the steering forces generated by the differential effect between the outer and inner wheels on curved track which increases the tendency for hunting oscillations of the wheelsets to occur while allowing both wheels to carry out substantially rolling movement as the truck traverses track curves; and wheelset coupling means interconnecting the wheelsets directly to link their turning movements in opposite sense to avoid interfering with the self-steering ability of each wheelset on track curves and to cause pivoting of either wheelset to produce substantial opposite pivoting of the other wheelset as the truck traverses straight and curved track, thereby the coupling means provides oscillation transmission between the wheelsets for damping of the increased hunting tendency of the wheelsets.

2. A railway truck as claimed in claim 1 in which the coupling means includes an elastic link which interconnects one bearing means of one wheelset with the diagonally opposite bearing means of an adjacent wheelset.

3. A railway truck as claimed in claim 2, in which elastic links which cross each other are provided to interconnect both bearing means of each wheelset with a diagonally opposite bearing means of an adjacent wheelset.

4. A railway truck as claimed in claim 2, in which the elastic link is connected to each bearing means by a vertical pivot so that the elastic link is rotatable in a horizontal plane relative to the bearing means.

5. A railway truck as claimed in claim 1, in which the coupling means includes two forked members each of which has an apex and two arms extending from the apex, the apices of the forked members being articulated to each other and the arms of each member being connected to the bearing means of a common wheelset.

6. A railway truck as claimed in claim 5, in which the apices of the forked members are connected to each other through a resilient member.

7. A railway vehicle including two trucks and a superstructure pivotally mounted on the trucks, each truck comprising at least two live wheelsets each having a pair of spaced wheels solidly mounted on an axle; axle supported bearing means adjacent each wheel; load bearing means for distributing truck load forces to each bearing means; the truck being characterized by each wheelset being self-steering in that its wheels each have a profiled tread of high effective tread conicity to obtain a differential effect between the wheel diameters of the outer and inner wheels on curved track; elastic constraint means supportingly positioned between the load bearing means and each axle supported bearing means, and providing elastic constraints to relative lateral and yawing movement between each wheelset and the load bearing means wherein the forces of elastic constraint on each wheelset are lower than the steering forces generated by the differential effect between the outer and inner wheels on curved track which increases the tendency for hunting oscillations of the wheelsets to occur while allowing both wheels to carry out substantially rolling movement as the truck traverses track curves; and wheelset coupling means interconnecting the wheelsets directly to link their turning movements in opposite sense to avoid interfering with the self-steering ability of each wheelset on track curves and to cause pivoting of either wheelset to produce substantial opposite pivoting of the other wheelset as the truck traverses straight and curved track, thereby the coupling means provides oscillation transmission between the wheelsets for damping of the increased hunting tendency of the wheelsets.

8. A railway truck including in combination:

a. a load-bearing structure;

b. two live axle wheelsets each comprising a pair of wheels fixed on an axle;

c. bearing means on each wheelset;

d. resilient means between the load-bearing structure and the bearing means for supporting the load-bearing means and providing elastic constraints to lateral and yawing movement of each wheelset with respect to the load-bearing structure;

e. profiled wheel treads of high effective conicity on each wheel to obtain a differential effect between the rolling diameters of the inner and outer wheels on curved track to generate steering forces on each wheelset which urge each wheelset to yaw into a radial position during transit through a curve with the wheelsets yawing in opposite senses;

f. the elastic constraints of (d) being lower than the steering forces of (e) so that each wheelset is able to yaw into a radial position in a curve while moving laterally with respect to the track to attain a suitable differential in rolling diameters between the inner and outer wheels such that the wheels perform a substantially purely rolling motion whereby each wheelset is self-steering; and g. resilient coupling means connected between the bearing means on the wheelsets to link yawing movements of each wheelset in opposite sense to that of the other wheelset to allow each of the wheelsets naturally to yaw in a curve so that the self-steering ability of each wheelset is maintained while, on the occurence of hunting oscillations of the wheelsets, the coupling means transmits such oscillations between the wheelsets such that these oscillations are in opposite phase for damping the increased hunting tendency of the wheelsets.

9. A railway truck as claimed in claim 8, in which each bearing means comprises a bearing mounted on the axle of the wheelset and an adaptor mounted on the bearing, the adaptor having a web which straddles the bearing and a pair of flanges which extend from the web to opposite sides of the axle, each of the flanges providing a mounting surface for a resilient element.

10. A railway truck as claimed in claim 9 in which each resilient element includes an elastomeric body.

11. A railway truck as claimed in claim 8, including a longitudinal anchor connected between the wheelsets to restrain the centers of gravity of the wheelsets longitudinally with respect to one another while maintaining the self-steering characteristics of either wheelset.

12. A railway truck as claimed in claim 8, in which the coupling means comprises a pair of links which cross each other, each link extending diagonally across the truck and being connected at each end to an axle-mounted bearing means.

13. A railway bogie for a railway vehicle, the bogie having a longitudinal axis in its direction of travel and including in combination:

a. a pair of longitudinally extending side-frames;

b. a bolster resiliently supported on the side-frames and having means for pivotally supporting a body of a railway vehicle;

c. a pair of live wheelsets each comprising a pair of wheels solidly mounted on an axle; the wheels each having a profiled tread of high effective conicity whereby steering forces are generated on each wheelset on curved track;

d. axle-supported bearing means on each wheelset, each bearing means comprising a bearing on the axle of the wheelset and an adaptor supported on the bearing;

e. elastic means mounted on each adaptor and supporting a side-frame, the elastic means providing elastic constraints on each wheelset with respect to the side-frames which are lower than the steering forces generated on each wheelset on curved track; and f. coupling means resiliently interconnecting the wheelsets to each other to link yawing movements of either wheelset in opposite sense to the other wheelset for counteracting hunting oscillations of the wheelsets while maintaining the natural steering characteristic of either wheelset.

14. A railway truck as claimed in claim 13, in which the coupling means comprises a pair of yokes which are articulated to each other at their apices and which are each connected to a wheelset.

* * * * *

UNITED STATES PATENT OFFICE

CERTIFICATE OF CORRECTION

Patent No. 4,067,261 Dated January 10, 1978

Inventor(s) Herbert Scheffel

It is certified that error appears in the above-identified patent and that said Letters Patent are hereby corrected as shown below:

Column 1, line 52, change "as" to --or--.

Column 4, line 33, Insert --track-- after "inches".

Column 6, line 45, change "in" to --is--.

Column 7, line 63, change "224" to --244--.

Column 8, line 28, change "of" to --the--.

Column 10, line 7, insert --326 in the event of excessive relative vertical movement between the adaptor and bearing. A pin 329 passing through registering holes in the adaptor 326 and a relatively larger hole in the side-frame 310 is provided to hold the adaptor-- after "adaptor" in line 7.

Column 16, line 45, delete ";" after "means".

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*